United States Patent [19]

Mitsuhashi et al.

[11] 4,299,900

[45] Nov. 10, 1981

[54] ELECTROSTATIC IMAGE MAGNETIC DEVELOPING PROCESS

[75] Inventors: Yasuo Mitsuhashi, Yokohama; Masashi Kiuchi, Kawasaki; Yoshio Takasu, Tama; Hiroshi Fukumoto, Kawasaki; Takashi Hino, Tokyo; Masaki Uchiyama, Kawasaki, all of Japan

[73] Assignee: Canon Kabushiki Kaisha, Tokyo, Japan

[21] Appl. No.: 128,859

[22] Filed: Mar. 10, 1980

[30] Foreign Application Priority Data

Mar. 9, 1979 [JP] Japan ..... 54-27324
Mar. 9, 1979 [JP] Japan ..... 54-27325

[51] Int. Cl.[3] ..... G03G 13/09
[52] U.S. Cl. ..... 430/122; 430/126; 430/107; 118/657
[58] Field of Search ..... 430/126, 122, 107; 118/657

[56] References Cited

U.S. PATENT DOCUMENTS 3,909,258 9/1975 Kotz ..... 430/122

FOREIGN PATENT DOCUMENTS 1165405 10/1969 United Kingdom .
1165406 10/1969 United Kingdom .

*Primary Examiner*—John D. Welsh
*Attorney, Agent, or Firm*—Fitzpatrick, Cella, Harper & Scinto

[57] ABSTRACT

A process for development comprises arranging an electrostatic image bearing member having electrostatic images on the surface and a developer carrying member at a predetermined space, an insulating magnetic developer containing 10–50% by weight of magnetic toner particles 20–35 microns in size being carried on the developer carrying member in a thickness thinner than the predetermined space, and transferring the insulating magnetic developer to the electrostatic image bearing member in the presence of a magnetic field.

According to this process for development, there can be produced developed images of high fidelity, high density and high resolution and free from fog.

11 Claims, 6 Drawing Figures

ELECTROSTATIC IMAGE MAGNETIC DEVELOPING PROCESS

BACKGROUND OF THE INVENTION

1. Field of the Invention

This invention relates to a new process for development in electrophotographic processes where insulating magnetic toners are employed.

2. Description of the Prior Art

There are known many electrophotographic processes such as those disclosed in U.S. Pat. No. 2,297,691, British Pat. Nos. 1,165,406 and 1,164,405. Most widely used are processes comprising utilizing a photoconductive material, forming electric latent image on a photosensitive material by an optional means, developing the latent images with a toner, if desired, transferring the images thus developed to an image receiving member such as paper, and then fixing the developed toner images by heat, pressure, solvent vapor or the like. There are known various methods for visualizing electric latent images by a toner. For example, there are known magnet brush methods as disclosed in U.S. Pat. No. 2,874,063, cascade developing methods as disclosed in U.S. Pat. No. 2,618,552, powder cloud methods as disclosed in U.S. Pat. No. 2,221,776, fur brush methods, liquid developing methods and the like.

Among these developing methods, there are widely used, in practice, magnet brush methods, cascade methods, liquid developing methods and the like where the developer is mainly composed of toner and a carrier. These developing methods can produce relatively stably a good image, but suffer from degradation of carrier and variation of the mixing ratio of the toner and the carrier which are common and inherent drawbacks of two-component developers.

For the purpose of avoiding such drawbacks, it has been proposed to use one-component developers composed of toner only, and among them, methods using a developer composed of magnetic toner particles give a good result.

U.S. Pat. No. 3,909,258 disclosed a process for developing with a magnetically attractable, electronically conductive toner where a developer composed of the toner is carried on a conductive sleeve of drum type having magnets inside and the development is carried out by contacting the developer with electrostatic images. At the developing portion an electrically conductive path is formed by the toner paticles between the surface of an image receiving member and the sleeve surface, and electric charge is led from the sleeve to the toner particles through the electronically conductive path, and the toner particles attach to the image portions by Coulomb force to develop the image portions.

The above mentioned developing method using the magnetically attractable, electronically conductive toner is a good method free from inherent problems of two-component developing methods, but it is difficult to transfer electrostatically the developed images to a final support such as plain paper from the developed image bearing member because the toner is electrically conductive.

As a developing method where a highly resistive and magnetic toner capable of being transferred electrostatically is employed, Japanese Patent Laid-Open No. 94140/1977 discloses a process for development utilizing induction polarization of toner particles, but the process suffers from disadvantages such as low developing speed and insufficient density of the developed images, and is practised with difficulty.

A further method of development using a highly resistive and magnetic toner is a method comprising triboelectorically charging the toner particles by the friction of toner particles contacting each other, the friction between toner particles and a sleeve, and the like, and bringing the toner particles thus charged into contact with an electrostatic image bearing member to develop the electrostatic images. However, this method suffers from the disadvantages tht the amount of contact between the toner paticles and the friction member is too small to be sufficiently charged and the toner particles thus charged are more strongly affected by Coulomb force between the toner particles and the sleeve and thereby are liable to agglomerate on the sleeve. The practical operation is effected with difficulty.

One-component developing methods practically used up to now are the method of U.S. Pat. No. 3,909,258 and methods similar thereto. The practically important features of this U.S. Patent are that the toner is conductive and the toner contains 50% by weight or more of a magnetic material. These two features are adventageous in the developing step, but the former is disadvantageous in the transferring step and the latter is disadvantageous in the fixing step. In other words, since the toner is conductive, and electrostatic transferring is difficult as mentioned above and even if the resistance is adequately controlled, the transferring efficiency is remarkably lowered. In addition, the content of magentic materials in the toner is as high as 50% by weight or more so that a lot of energy is necessary for fixing by heated press rollers. In other words, when a large amount of non-melting materials is contained in the toner, contact between toner particles one another or between toner particles and a toner image bearing member is not so tight that a lot of heat energy or a high pressure is required.

SUMMARY OF THE INVENTION

An object of the present invention is to provide a process for development producing developed images of high fidelity and stable image quality.

Another object of the present invention is to provide a process for development producing developed images of sufficient and uniform density and high resolution and free from fog.

A further object of the present invention is to provide a process for development which gives images of good quality and high density even at a high temperature and high humidity.

According to the present invention, there is provided a process for development which comprises: arranging an electrostatic image bearing member having electrostatic images on the surface and a developer carrying member at a predetermined space, an insulating magnetic developer containing 10–50% by weight of magnetic toner particles of 20–35 microns in size being carried on the developer carrying member in a thickness thinner than the predetermined space, and transferring the insulating magnetic developer to the electrostatic image bearing member in the presence of magnetic field.

Further in the above-mentioned process for development, distribution of particle size of the toner particles is preferably that toner particles of 20–35 microns in size are contained in an amount of 10–35% by weight, toner particles of not more than 5 microns are contained in an amount of not more than 1% by weight, preferably not more than 0.5% by weight, toner particles of exceeding 35 microns in size are not more than 10% by weight, preferably not more than 6% by weight and the remaining is toner particles of 5–20 microns in size. By selecting the above mentioned distribution of particle size of the toner, stable and good images can be produced regardless of change of humidity, and even when many sheets of copy are produced, distribution of size of toner particles is kept constant and a stable development can be effected.

DESCRIPTION OF THE PREFERRED EMBODIMENTS

Figure 1:
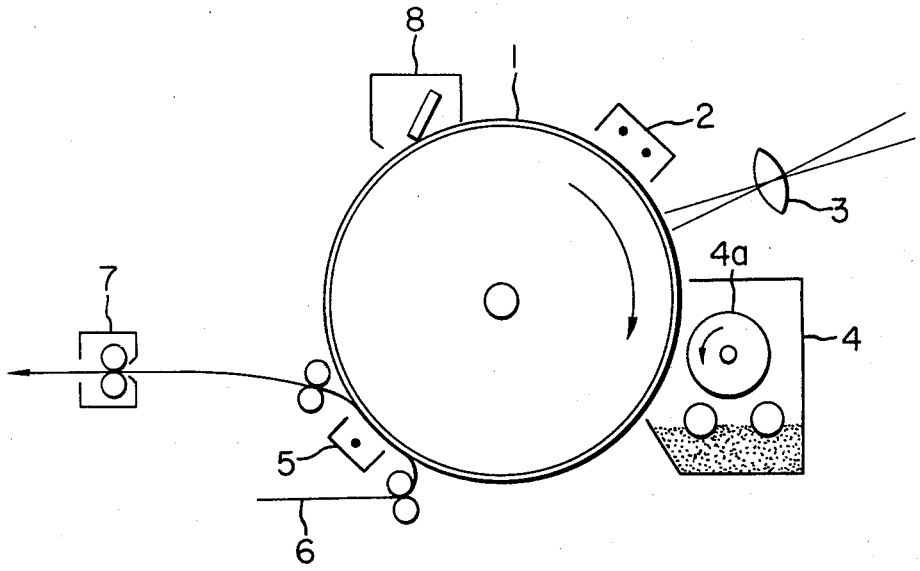
FIG. 1 shows diagrammatically an embodiment of a copying or recording apparatus by which the process for development according to the present invention can be carried out.

Referring to FIG. 1, an electrostatic image bearing member 1 is a photosensitive member drum provided with a photoconductive layer. The drum may or may not have an insulating layer on the surface, and the photosensitive member may be in a form of sheet or belt as well as drum. 2 denotes a known charging apparatus and 3 denotes a light image projection apparatus for projecting manuscript images, light images or light beams modulated by image signals. Electrostatic images are formed on photosensitive member 1 by those apparatuses. Developing apparatus 4 is provided with developer carrying member 4*a*. Visible toner images corresponding to the electrostatic images are produced on photosensitive member 1 by the developing apparatus.

5 denotes a device for transferring the resulting visible toner images onto image receiving member 6. If desired, electric charge is applied to the visible toner images in advance by corona discharging or the like so as to improve the transfer. There may be used a so-called electrostatic image transferring system, for example, electrostatic images on photosensitive member are once transferred to another image bearing member and then developed to visible images by developing apparatus 4. The visible images are fixed to image receiving member 6 by a fixing device 7 which is provided with at least two rollers having a means for pressing or both heating and pressing. Photosensitive member 1 is cleaned after transferring by cleaning device 8 to remove the remaining toner on photosensitive member 1 and the photosensitive member is reused.

Steps of electrophotographic methods where the development of the present invention can be effected are exemplified below.

First of all, a step of forming electric latent images is as shown below. Electrophotographic photosensitive members may be in any of various forms depending upon the electrophotographic process to be applied and the predetermined characteristic to be obtained.

A representative electrophotographic photosensitive member is that comprising a substrate, a photoconductive layer overlying the substrate, and if desired, additionally an insulating layer on the surface, and is widely used. A photosensitive member composed of a substrate and a photoconductive layer may be used for a most usual electrophotographic process comprising charging, imagewise exposure and development, and if desired, transferring.

With respect to the photosensitive member provided with an insulating layer, the insulating layer is arranged for the purpose of protecting the photoconductive layer, improving mechanical strength of the photosensitive member and dark decay characteristics, or adapting the photosensitive member to a particular electrophotographic process, or for preventing public pollution or the like.

Examples of photosensitive member having an insulating layer or electrophotographic processes utilizing a photosensitive member having an insulating layer are disclosed in U.S. Pat. No. 2,860,048, Japanese Patent Publication Nos. Sho 41-16429, 38-15446, 46-3713, 42-19747 and 36-4121. In particular, a representative electrophotographic process comprises transferring electric charge to a portion between an insulating layer and a photoconductive layer by injecting electric charge from the substrate side upon charging. Examples of such process are disclosed in Japanese Patent Publication Nos. Sho 42-23910 and 42-24748. The process comprises primary charging, secondary charging of an opposite polarity to that of the primary charging or AC discharging simultaneously with imagewise exposure and a blanket exposure (this blanket exposure may be omitted if desired) to produce electrostatic images.

In the above proces, the imagewise exposure may be effected before or after the secondary charging or AC discharging as disclosed in Japanese Patent Publication Nos. Sho 42-19748, 44-13437 and 49-44902.

Electrophotographic photosensitive members are subjected to a predetermined electrophotographic process to produce electrostatic images and the electrostatic images are developed to visualize.

Some of the representative image bearing members may be used in the following electrophotographic processes.

(1) As disclosed in Japanese Patent Publication Nos. Sho 32-7115, 32-8204 and 43-1559, for the purpose of improving the repeating durability of an electrophotographic photosensitive member, electrostatic images formed on the electrophotographic photosensitive member are transferred to another image bearing member and then developed followed by transferring the resulting toner images to an image receiving member.

(2) Another electrophotographic process in which electrostatic images corresponding to electrostatic images formed on an electrophotographic photosensitive member are formed on another image bearing member is disclosed in, for example, Japanese Patent Publication Nos. Sho 45-30320 and 48-5063 and Japanese Patent Laid Open No. Sho 51-341. The process comprises forming electrostatic images on a screen-like electrophotographic photosensitive member having a number of tiny openings, applying a corona charging treatment to another image bearing member by way of the electrostatic images to modulate a corona ion current and thereby form electrostatic images on said another image bearing member, developing with a toner and transferring the developed images onto an image receiving member.

(3) According to a further electrophotographic process, electric signals are applied to multistylus electrodes to produce electrostatic images corresponding to the electric signals on the surface of an image bearing member.

The image bearing members used in the electrophotographic processes as (1)-(3) above are not required to have a photoconductive layer if the electrostatic image bearing surface of the image bearing member is insulating. In such a manner as above, as an image bearing member on which electrostatic images are to be formed, there may be used any of various members such as electrophotographic phtosensitive members, member having an insulating surface and the like.

The developing step employed in the present invention is described below.

Figure 2:
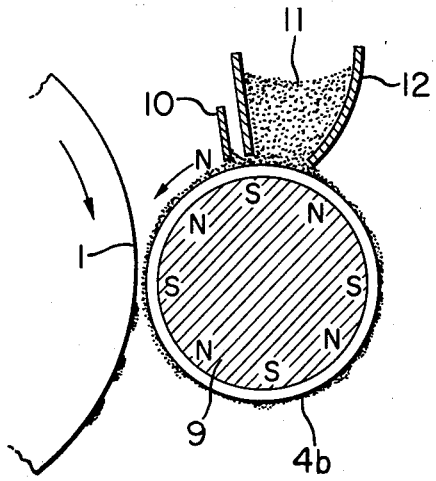
FIG. 2 is a cross sectional view of an apparatus where the process of the present invention is being carried out.

FIG. 2 shows a cross sectional view of an embodiment of the developing step as used in the present invention. Electrostatic image bearing surface 1 rotates in the direction of arrow, and multipolar permanent magnet 9 is not rotated, but fixed. Non-magnetic drum 4*b*, a developer carrying member, is rotated in the same direction as the electrostatic image bearing surface 1 (It should be noted that this "same direction" means that it is concerned with the region where the surface 1 and the drum 4 are brought near. The surface 1 itself rotates clockwise while the drum 4 itself rotates counterclockwise in FIG. 2.). Therefore, one-component insulating magnetic developer 11 fed from developer vessel 12 is coated on the non-magnetic drum surface, and the friction between the drum surface and the toner particles gives to the toner particles an electric charge of the opposite polarity to the charge of the electrostatic images.

An iron doctor blade 10 is arranged adjacent to the surface of the drum (the distance being 50-500 microns) and facing to one magnetic pole (FIG. 2 shows S-pole) of the multipolar permanent magnet 9. Thus, the thickness of the toner layer can be controlled to be thin (for example, 30-300 microns) and uniform. By controlling the rotating speed of drum 4*b*, the surface layer speed of the developer layer, preferably the speed of the inside portion of the developer layer, is made substantially equal to or near the speed of the electrostatic image bearing surface. In place of iron doctor blade lo, there may be used a permanent magnet to form a counter magnetic pole. In addition, an AC bias may be applied between the developer carrying member and the electrostatic image bearing surface.

As described above, in this developing step a non-magnetic drum 4*b* containing a multipolar permanent magnet 9 is used so as to stably carry one-component magnetic developer on the developer carrying member, and a doctor blade 10 of a magnetic thin plate or permanent magnet is disposed adjacent to the surface of drum 4*b* so as to form a uniform and thin developer layer.

When a doctor blade of a magnetic member is used, a counter magnetic pole is formed with respect to the magnetic pole of the permanent magnet contained in the developer carrying member, and this forces toner particle chains to rise between the doctor blade and the developer carrying member, and then, after passing the blade, the raised toner particles sink again and the developer layer becomes thinner. Therefore, the magnetic member doctor blade serves to give a thin developer layer, which can produce developed images of high quality when faced to the electrostatic image bearing member. Further, by applying such forced mevement to the developer, the developer layer becomes more uniform and there is obtained a thin and uniform toner layer which can not be achieved by a doctor blade of a non-magnetic member.

As mentioned above, according to a process of U.S. Pat. No. 3,909,258 which is now commercially used, the toner particles are retained on the surface of a sleeve and transferred to the developing portion by only a magnetic constraining force between the toner particle and the permanent magnet in the developing apparatus, and therefore it is inevitable that the content of magnetic powders in the toner is more than 50% by weight.

If the magnetic field of the permanent magnet is remarkably increased, the magnetic powder content in the toner can be decreased, but this results in a large scale of the developing apparatus and the cost becomes expensive, and therefore, such measures can not be practically employed.

On the contrary, according to the present invention, the toner is retained and transferred by a magnetic constraining force between the toner particles and the permanent magnet in the developing apparatus and an electric attraction force due to friction between toner particles and the sleeve surface, and therefore, it is possible to decrease the content of magnetic material in the toner. On the other hand, according to the present invention, charge amount of toner particles in very small as compared with that of U.S. Pat. No. 3,909,258, and therefore, at a sleeve surface magnetic flux density of 200-1300 gauss, preferably 600-1300 gauss as used for the purpose of obtaining images free form fog, it is necessary that the content of magnetic powders in toner is 10-50% by weight, preferaby 15-35% by weight. If the content is not in the above mentioned range, it is not possible to transfer effectively toner particles to the surface of latent images by overcoming a magnetic force holding the toner particles when the developer layer is brought near the electrostatic images.

According to the process for development of the present invention, a developer layer is formed in such a way that the developer layer does not contact the non-image portions on the electrostatic image bearing surface and the developer transfers to the image portions on the electrostatic image bearing surface, and the development is effected by means of the developer layer. The image portion as referred to here is a portion to which toner particles are to be attached. The non-image portion as referred to here is a portion to which toner particles are not to be attached, that is, a background portion. Upon transferring, the thickness of the developer layer corresponding to the image portion increases in the direction of the electric field by the attraction force of electric field, and further magnetic field acts to raise and grow the toner at the magnetic pole portion in such a manner that an ear grows (This phenomenon is called "toner elongation"). When the surface layer of the developer layer and the electrostatic image bearing surface are drawn near, the portion of toner elongation directly contacts image portions of the electrostatic image bearing surface, and then when the developer carrying member and the electrostatic image bearing surface are separated from each other, the toner remains on the surface of the electrostatic image bearing surface to accomplish development.

This developing process is different from so-called contact developing method or jumping developing method, and according to this developing process it is believed that the developer does not contact the non-image portions, but contacts the image portions by the toner elongation phenomenon.

When the gap between the surface layer of the developer layer and the electrostatic image bearing surface is larger than that as mentioned above, it is considered that the development proceeds in such a manner that, in addition to the development by the toner as mentioned above, the toner particle which do not reach the electrostatic image bearing surface though they elongate rise in the electric field, and the tip portion of the ear is torn away and flies to reach the electrostatic image bearing surface to effect development.

According to the present invention, there can be carried out a development that the above mentioned toner elongation and the flying happen in combination depending upon the gap between the electrostatic image bearing surface and the developer carrying member.

In this manner, by utilizing the toner elongation, it is possible to lessen the toner amount flying between the gap and thereby, to decrease the influence of the air stream flowing in the gap, gravity acting on the toner particles and vibration of the electrostatic image bearing surface and the developer carrying member to a great extent. As the result, there can be obtained an image reproducibility of high fidelity and visible images of excellent quality free from fog.

When the distance of gap, is set in conformity with those conditions, good results are obtained. In order to guarantee sufficiently the toner elongation, the distance of gap between the surface layer of developer (at non-image portion where rising and growing of toner particles do not happen) and the electrostatic image bearing surface is kept not more than 3 times the thickness of the developer layer.

The conditions under which the development is mainly carried by the elongation of toner and additionally by the flying of toner particles are that the distance of gap is not more than 10 times the thickness of the developer layer.

As the result of theoretical analysis of experiments and the consideration as mentioned above, the gap D between the developer carrying member and the electrostatic image bearing surface is preferably as shown below:

50 microns $\leqq D \leqq$ 500 microns

The upper limit is a value which enables to give small letters (100 microns in size) printed in the commercially available minimum type with a high resolution and the lower limit is an appropriate value which is determined in connection with thickness of the developer layer.

According to the result of experiments, thickness of the developer layer carried on the developer carrying member, a, is preferably as thin as the following:

30 microns $\leqq a \leqq$ 300 microns.

Upon development, such developer layer forms ears in the presence of magnetic field. The height of ears is usually about 3 times the thickness of the developer layer and therefore, for the purpose of letting the developer surface layer reach the electrostatic image bearing surface, it is necessary that the gap, b, between the developer surface layer and the electrostatic image bearing surface satisfy the following condition:

$b \leqq$ 300 microns

Further, when $b \leqq (a/5$, a good result is obtained, in general.

As mentioned above, in the developing step of the electrophotographic process of the present invention it is necessary that the toner generates an appropriate triboelectric charge when rubbed with a sleeve surface, and has an appropriate magnetic moment. That is, when the toner is coated on the surface of the sleeve in the form of a thin layer and is transferred into the electric field of the electrostatic latent inages and does not have a sufficient triboelectric charge, the developed density is lowered. In addition, when the toner does not have a sufficient magnetic moment, this causes fog.

Figure 3:
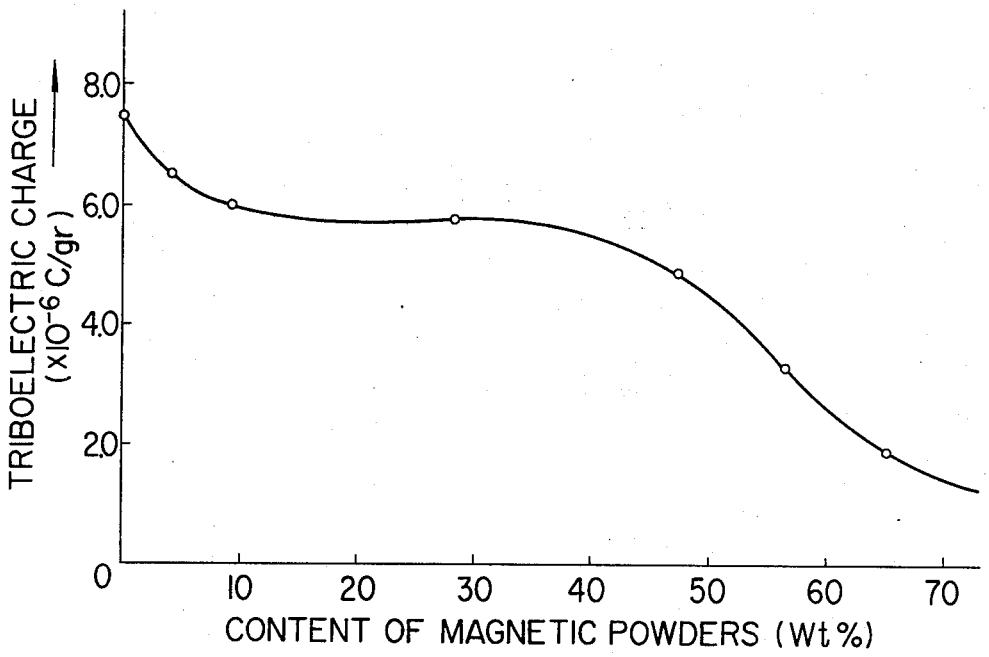
FIG. 3 is a graph for showing a relation between content of magnetic powders and triboelectric charge.
Figure 4:
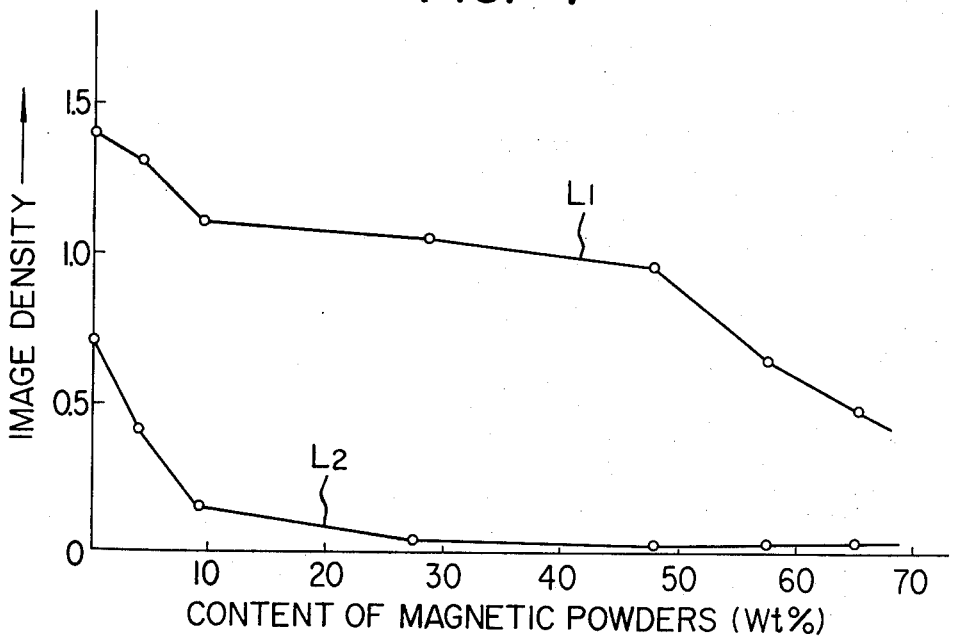
FIG. 4 is a graph for showing a relation between content of magnetic powders and image density.

Toner particles containing 0–70% by weight of magnetic powders are measured with respect to triboelectric charge and image density. The results are illustrated in FIGS. 3 and 4. In FIG. 4, $L_1$ and $L_2$ stand for maximum density and fog density, respectively. As is clear from FIG. 3, when content of magnetic powders exceeds 50% by weight, the triboelectric charge decreases to a great extent and the image density decreases to that lower than the practical level. It is believed that this is due to the fact that electric resistance of the magnetic powders (magnetite) used is so low that generation of an appropriate triboelectric charge is distributed. Further, as is clear from FIG. 4, when the content of magnetic powders is not more than 10% by weight, the toner gives unclear images with large fog since magnetic constraining force in the sleeve magnetic field is small and elongation of magnetic brush is irregular and the toner particles are projected to non-image portions.

In the following, the dependence of forces acting on toner particles on the particle size is considered below so as as to know the easiness of development depending upon the size of toner in the development of the present invention.

Force, F, acting on toner particles is the sum of a force caused by latent image charge on a photosensitive member, Fe, a force caused by charge of the toner layer on the sleeve, Ft, magnetic constraining force, Fm, gravity, Fg, and short distance force such as coagulation force among toner particles, Fs, and it is shown as sollows:

$$F = Fe + Ft + Fm + Fg + Fs$$

Fe is approximately expressed by the following formula:

$$Fe = \frac{VoPt}{\epsilon t \cdot la + \frac{\epsilon t}{\epsilon i} li + \frac{\epsilon t}{\epsilon p} lp + lt}$$

where Vo is latent image electric potential, $\epsilon t$ dielectric constant of toner layer, $\epsilon i$ dielectric constant of insulating layer, $\epsilon p$ dielectric constant of photosensitive layer, lt thickness of toner layer, la air gap, li thickness of insulating layer, lp thickness of photosensitive layer and electric charge amount of toner particles Pt.

$$Ft = \frac{P \cdot Pt(\epsilon i \cdot lt + \epsilon t \cdot \epsilon i \cdot la + \epsilon t \cdot li)}{2\,\epsilon i \cdot \epsilon t \cdot \epsilon p} \cdot lt^2$$

where P is electirc charge density of toner layer.

$$Fm = M \cdot \frac{\partial H}{\partial Z}$$

where M is intensity of magnetization of a toner particle, H, is strength of magnetic field, and Z is a position of a toner particle relative to a magnet.

$Fg = mt \cdot g$ where mt is weight of toner particles. When Fs is neglected and each force is calculated for lt = 130 microns, la = 20 microns and Vo = 500 V, and F is plotted against the particle size, the result is shown in FIG. 5.

Figure 5:
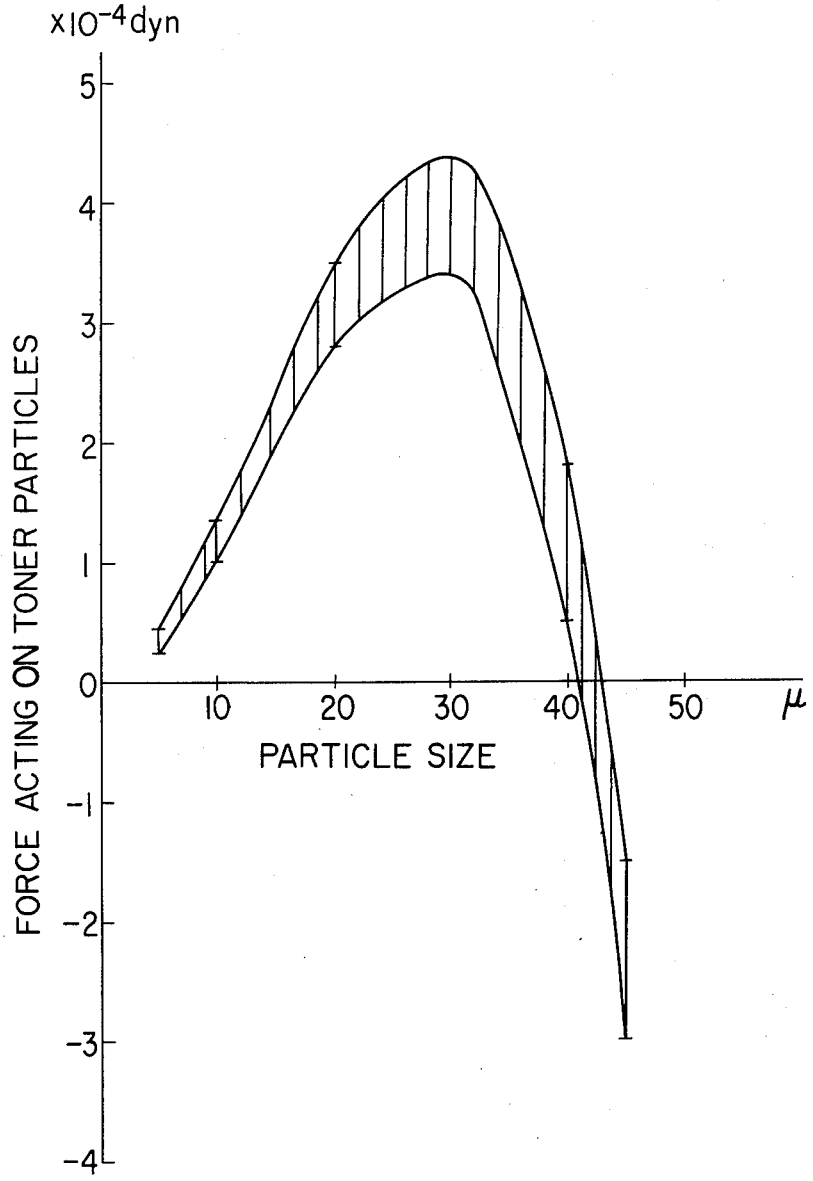
FIG. 5 is a graph for showing a relation between particle size of a toner and force acting on the toner particles.

However, in the region where the toner particle size is small, Fs is so important that the result may be somewhat deviated from the result of FIG. 5. The force acting on toner particles in FIG. 5 has a width because the force acting on the upper portion of the toner layer is different from the force acting on the lower portion of the toner layer.

In the following, the relation between easiness of development and toner particle size is shown. In the developing apparatus in FIG. 2, the developing device of a fixed magnet and rotating sleeve type has the following dimensions. Sleeve **4*b* has a diameter of 50 mm, the sleeve surface magnetic flux density is 700 gauss, the gap between the surface of sleeve 4*b* and the ear cutting blade 10 is 100 microns, and the gap between the surface of sleeve 4*b*** and the surface of the photosensitive drum is 150 microns.

As a developer, a magnetic toner of a predetermined weight (W) and having a broad particle distribution ranging from 1 micron to 50 microns is placed in a developer vessel 12, and image developing is carried out until the weight of magnetic toner decreases to 1/10. The particle weight distribution is measured at the beginning and at the time when the weight decreases to 1/10, that is, it is a function of particle size $\theta$ and the former and the latter are represented by W1 ($\theta$)% and W2($\theta$)%, respectively.

Thus the rate of consumption of toner as the result of image development can be represented by the following formula as a function of $\theta$.

$$\text{Rate of consumption} = \frac{W\,w1(\theta) - \frac{W}{10}\,w2(\theta)}{W\,w1(\theta)}$$

Figure 6:
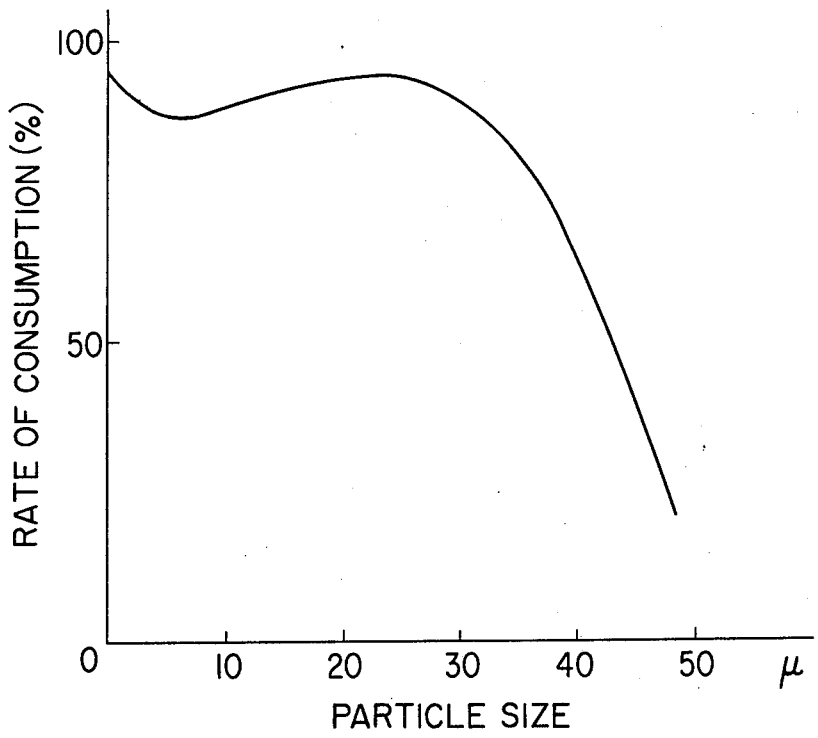
FIG. 6 is a graph for showing a relation between particle size of a toner and a rate of consumption of the toner particles.

FIG. 6 is a graph in which rate of consumption is plotted against particle size $\theta$. The larger the rate of consumption, the easier the development. But the smaller the rate of consumption, the more difficult the development, and this means that the toner is liable to be accumulated in the developer vessel. FIG. 6 indicates that toner particles of 10–35 microns in size are ready to transfer to the surface of latent images to develop them while toner particles of exceeding 35 microns in size do not serve for development and are liable to be accumulated in the developer vessel and on the sleeve. Rate of consumption of toner particles of not more than 5 microns in size is high. This is considered to be due to the phenomenon that the small particles adhere to the large particles and development is conducted by the composite particles and further small toner particles agglomerate and the resulting agglomerate particles take part in development. The data shown in FIG. 6 varies, to some extent, depending upon various conditions involved in the development, but the tendency is almost the same as far as magnetic flux density is 600–1300 gauss, thickness of the developer layer on the sleeve is 30–300 microns, and the gap between the sleeve surface and the surface of the photosensitive member is 50–500 microns.

On the other hand, the relation between image quality and particle size is as shown below. At a circumstance of normal temperature and normal humidity, the best image quality is obtained when the average particle size is about 5–10 microns, and when the average particle size is not more than 5 microns, the image density is low and the image quality is poor. When the average particle size is 10–20 microns, there are obtained practically good results, but when the average particle size exceeds 20 microns, there are obtained poor images which are in a form of scattered toner particles. Therefore, a toner composed of toner particles of about 5–20 microns in size in which toner particles of 5–10 microns is size occupy the most portion is preferable.

However, at a high humidity a toner mainly composed of toner particles of 5–10 microns suffers from agglomeration of the toner particles and there are obtained only poor image quality. In this case, it has been found that the agglomeration of toner particles hardly occurs and good image quality is obtained where 10–50% by weight, preferably 10–35% by weight, of toner particles of 20–35 microns in size is contained in addition to toner particles of 5–20 microns in size.

When the toner contains toner particles of 20–35 microns in size only, there can not be obtained the best quality of image, but when such toner contains additionally toner particles of small size, agglomeration of such small size toner particles is prevented, and as shown in FIG. 6, toner particles of 20–35 microns in size are not accumulated on the sleeve when developed many times. Further, at a high humidity the toner particles exceeding 35 microns in size transfer to the latent image surface only in a small amount upon development and is liable to accumulate and thereby the resolution is lowered. Therefore, contents of such toner particles in the developer are preferably not more than 10% by weight, more preferably not more than 6% by weight. Further, where toner particles of not more than 5 microns in size are contained in a large amount, the toner has a poor fluidity and the resulting image density is lowered and therefore, contents of such toner particles is preferably not more than 1% by weight, more preferably not more than 0.5% by weight.

In view of the foregoing, in the above mentioned process of development good images are obtained even at a high humidity as well as at normal temperature and normal humidity and the image quality is not deteriorated and, even upon copying many times, a high durability is obtained where the insulating magnetic developer contains 10–50% by weight of magnetic toner particles of 20–35 microns in size, not more than 10% by weight of magnetic toner particles exceeding 35 microns in size and not more than 1% by weight of magnetic toner particles of not more than 5 microns.

The measurement of distribution of particle size can be made by method of measuring distribution of the number of particles concerning particle size of fine particles such as that known as an optical microscope method and the result is converted to weight %.

In other words, when the number of a particle having a particle size, x, is designated as n(x), the weight % of the particle of "x" in size is calculated by the formula:

$$\frac{n(x) \cdot x^3}{\Sigma n(x) \cdot x^3}$$

As a step for transferring the toner images to an inage receiving member, an electrostatic transferring system is preferable, and a corona transferring system or a roller transferring system may be used as well. In addition, as a step for fixing the toner images thus transferred, there may be used heat fixation or pressure fixation.

The insulating magnetic toner particles of the developer employed in the present invention may be composed of a binder material, magnetic powders and if desired, additives.

As the binder material, there may be used any of known binder materials for toner where a pressure and heat roller fixing device of oil coating type as mentioned later is used. There may be used, for example, the following materials: homopolymers of styrene or substituted styrene such as polystyrene, poly-p-chlorostyrene, polyvinyltoluene and the like, copolymers of styrene such as:

styrene-p-chlorostyrene copolymer,
styrene-vinyltoluene copolymer,
styrene-vinylnaphthalene copolymer,
styrene-acrylic acid ester copolymer,
styrene-methacrylic acid ester copolymer
styrene-methyl-α-chloromethacrylate copolymer,
styrene-acrylonitrile copolymer,
styrene-vinyl methyl ether copolymer,
styrene-vinyl ethyl ether copolymer
styrene-vinyl methyl ketone copolymer,
styrene-butadiene copolymer,
styrene-isoprene copolymer,
styrene-acrylonitrile-indene copolymer,
and the like, polyvinyl chloride, phenolic resins, natural resin modified phenolic resins, natural resin modified maleic acid resins, acrylic resins, methacrylic resins, polyvinyl acetate, silicone resins, polyester resins, polyurethanes, polyamide resins, furan resins, epoxy resins, xylene resins, polyvinyl butyral, terpene resins, coumarone-indene resins, petroleum resins, and the like.

When there is used a heat and pressure roller fixing system where oil coating is not involved, offset, i.e. transfer of a part of the toner images on a toner image bearing support member to a roller, and close contact of the toner with a toner image bearing support member are very important problems.

Toners capable of being fixed by only a small amount of heat energy are liable to cause blocking or caking during usual storage or in a developer vessel. Therefore, this problem should be also taken into consideration. These phenomena are affected by physical properties of the binder material in the toner to a great extent. The present inventors have found that adhesion of toner to a toner image support member is improved upon fixation when contents of a magnetic member in toner is decreased, but offset is liable to occur and also blocking and caking are liable to form.

Therefore, when a heat and pressure roller fixing system without oil coating is used in this invention, selection of binder material is very important.

As a preferable binder material, there may be mentioned crosslinked styrence series copolymers.

As comomoners copolymerized with styrene for styrene copolymers, there may be mentioned monocarboxylic acids or substituted monocarboxylic acids having a double bond such as acrylic acid, methyl acrylate, ethyl acrylate, butyl acrylate, dodecyl acrylate, octly acrylate, phenyl acrylate, methacrylic acid, methyl methacrylate, ethyl methacrylate, butyl methacrylate, octyl methacrylate, acrylonitrile, methacrylonitrile, acrylic amide and the like, dicarboxylic acids or substituted dicarboxylic acids having a double bond such as maleic acid, butyl meleate, methyl maleate, dimethyl meleate and the like, vinyl esters such as vinyl chloride, vinyl acetate, vinyl benzoate, and the like, ethylenic series olefins such as ethylene, propylene, butylene and the like, vinyl ketones such as vinyl methyl ketone, vinyl hexyl ketone, and the like, vinyl ethers such as vinyl methyl ether, vinyl ethyl ether, vinyl isobutyl ether and the like, and similar vinyl monomers. One or more of the comonomers may be used.

As a crosslinking agent, there are mainly used the compounds having two or more of polymerizable double bonds. Examples of such compounds are:

aromatic divinyl compounds such as divinyl benzene, divinyl napthhalene and the like, carboxylic acid esters having two double bonds such as ethylene glycol diacrylate, ethylene glycol dimethacrylate, 1,3-butanediol dimethacrylate and the like, divinyl compounds such as divinyl aniline, divinyl ether, divinyl sulfide, divinyl sulfone and the like, and compounds having 3 or more vinyl groups. These compounds may be used alone or in combination.

When a pressure fixing system is used, it is possible to use known resin binders for pressure fixable toners. Examples of such resin binders are: polyethylene, polypropylene, polymethylene, polyurethane elastmer, ethylene-ethyl acrylate copolymer, ethylene-vinyl acetate copolymer, ionomer resins, styrene-butadiene copolymer, styrene-isoprene copolymer, linear saturated polyester and the like.

As magnetic powders used in the toner particles of the present invention, there may be used ferromagnetic elements, alloys and compounds containing such ferromagnetic element, alloys and compounds of iron, cabalt, nickel manganese and the like, such as magnetite, hematite, ferrite and the like, other ferromagnetic alloys, and other conventional magnetic materials.

Particle size of usually used magnetic powders is 0.05–5 microns, preferably 0.1–1 micron, in average particle size. The toner particles contain 10–50% by weight, preferably 15–40% by weight, more preferably 15–35% by weight of the magnetic powders. At this content, an appropriate magnetic moment acts in the above mentioned developing method and there can be produced good images and the fixation is also excellent.

Additives which may be contained in the toner particles of the present invention are added for the purpose of charge controlling, colorization, toning, imparting fluidity and the like, and are, for example, carbon black, various dyes and pigments, hydrophobic colloidal silica fine powders, plasticizers and the like.

Toner particles used in the present invention may be prepared as shown below.

Resin binder, magnetic particles, charge controlling agent and other toner components are mixed in a grinding and mixing device such as a ball-mill.

The resulting mixture is kneaded by means of a meltkneading machine such as a roll-mill, and after cooling, the resulting product is crushed roughly to small lumps of less than several mm. in size by means of a crusher such as a hammer mill, and then pulverized to finely divided particles by means of a supersonic jet pulverizer.

The resulting particles are as fine as 0.1–50 microns in size. These particles are classified to give a toner.

If the pulverization is controlled so as to obtain a predermined particle distribution before classification and the classification is carried out taking into consideration the specific gravity of toner and amount of feed, there can be obtained toners of a predermined particle size distribution.

In the above mentioned classification, cut at the finer powder side is effected by a wind classifier such as Mikroplex 132 MP(tradename, supplied by Alpin AG), Acucut A-12(tradename, supplied by Donaldson Co.), Micron separator MS-1(tradename, supplied by Hosokawa Iron Works Ltd.) and the like while cut at the coarser powder side is effected by a wind classifier such as Mikroplex 400 MP(tradename, supplied by Alpine AG), Micron separator MS-1(tradename, supplied by Hosokawa Iron Works Ltd.) and the like, and a filter classifier such as Blower shifter(tradename, supplied by Taikosha Co. Ltd.) and the like.

The above mentioned process for producing the toners used in this invention is only one example, and it should be noted that there are many other processes.

The process of U.S. Pat. No. 3,909,258, can be practically effected by forming latent images by using a ZnO paper, developing by an electric conductive toner, (omitting transfer since a conductive toner is employed), and fixing by a pressure fixing system since ZnO paper is used.

This process positively increases advantages of development, and the disadvantages are minimized by means of various steps. This process has succeeded by arranging the steps as mentioned above.

On the contrary, according to the present invention, an insulating and magnetic toner is coated on a sleeve in the form of a very thin layer to impart triboelectric charge to the toner and then development is effected. Thus developed images are free from fog and of a high resolution, and further electostatic transfer is possible since the toner is insulating. In the development of the present invention it is possible to decrease the amount of magnetic material in the toner as compared with conventional developments. As the result, roller fixation to an image receiving member such as plain paper becomes possible.

In view of the foregoing, it is clear that the content of magnetic powders in the toner used for the development of the present invention ranging from 10 to 50% by weight is very effective. This will be further exhibited in the following examples. The measurement of distribution of toner particles is conducted by means of Luzex 450(tradename, supplied by Nihon Regulator Co., Ltd.). Weight distribution is obtained by multiplying the frequency in the particle number distribution by the cube of a particle size.

EXAMPLE 1

70 parts by weight of a crosslinked styrene-butyl acrylate copolymer, 30 parts by weight of magnetic powders (magnetite, average particle size of 0.25 microns), and 2 parts by weight of a metal containing dye(tradename, Zapon Fast black B, produced by BASF) were mixed by a ball-mill, melted and kneaded by a roll-mill, after cooling, roughly crushing by a hammer-mill, and pulverized by a supersonic jet pulverizer. The resulting powders were classified and powders of 1–40 microns were used as a toner. Distribution of the particle size was as follows:

about 0.2% by weight of particles of not more than 5 microns in size, about 20% by weight of particles of 20–35 microns in size, and about 3% by weight of particles exceeding 35 microns in size.

100 parts by weight of the resulting toner and 0.3 parts by weight of a hydrophobic colloidal silica were mixed to form a developer, which was used for development.

A photosensitive drum comprising three layers, that is, an insulating layer of polyester resin, a photosensitive layer composed of CdS and acrylic resin, and a conductive substrate, was used, and the surface of the insulating layer was uniformly charged by corona discharge of +6 KV at a line surface speed on the drum of 168 mm/sec, subjected to an imagewise exposure simultaneously with an AC corona discharge of 7 KV and blanket exposure to form latent images on the surface of the photosensitive member.

A developing apparatus as in FIG. 2 having a sleeve of 50 mm in diameter, a sleeve surface magnetic flux density of 700 gauss, and a distance between an iron ear cutting blade and an aluminum sleeve of 0.1 mm, was set in such a way that the distance between the surface of the insulating layer and the surface of the sleeve is 0.15 mm, and the latent images were developed with the above mentioned developer, and then the resulting toner images were transferred to an image receiving paper while a DC corona of +7 KV is applied to the image receiving paper from the back side. And fixation is carried out by means of a fixing device of a commercially available dry electophotographic copying machine, NP 5000 (a heat roller fixing device where the roller is made of silicone rubber the surface of which is not coated with a silicone oil), and there were obtained images free from fog and of a high resolution and any offset was observed. Thickness of the toner layer on the sleeve was about 70 microns.

EXAMPLE 2

The procedures of Example 1 were repeated except that a magnet was used in place of the iron blade, and there was obtained substantially the same result as in Example 1.

EXAMPLE 3

The procedures of Example 1 were repeated except that a toner composed of 75 parts by weight of polystyrene, 25 parts by weight of magnetic powders(ferrite, average particle size of 0.53 microns), and 2 parts by weight of a metal containing dye was used. The metal containing dye was that in Example 1.

And, fixation was effected by a fixing device of a commercially available dry electrophotographic copying machine NP-5500(a heat roller fixing device in which a silicone rubber roller coated with a silicone oil) was used in place of the toner and the fixing device in Example 1. There was obtained substantially the same result as in Example 1.

EXAMPLE 4

The procedures of Example 1 were repeated except that a toner composed of 40 parts by weight of polyethylene, 25 parts by weight of styrene-butadiene copolymer, and 35 parts by weight of magnetic powders(needle-like magnetite, average particle size of 0.35 microns and axis ratio of 8/1) was used and fixation was effected at a pressure of 25 Kg/cm by using a fixing device composed of two metal rollers in place of the toner and the fixation in Example 1.

There was obtained a clear and sharp image free from fog, and the fixability was excellent.

EXAMPLE 5

The procedures of Example 1 were repeated except that the distance between the surface of the sleeve and the blade was 200 microns, the distance between the surface of the sleeve and the surface of the photosensitive drum was 300 microns, and an AC bias of 200 Hz and 500 V was applied to the surface of the sleeve at the developing portion. There was obtained substantially the same result as in Example 1. Thickness of the toner layer was about 120 microns.

EXAMPLE 6

The procedures of Example 1 were repeated except that 80 parts by weight of a styrene-butyl acrylate copolymer and 20 parts by weight of magnetic powders were used. The same result as in Example 1 was obtained.

EXAMPLE 7

Following the procedures of Example 1, there were prepared various toners which were different from that of Example 1 as to the amount of magnetic powders(-magnetite, EPT-1000, supplied by Toda Kogyo) as shown in Table 1.

TABLE 1

| Toner No. | Resin*1 (parts by weight) | Magnetic powders (parts by weight) | Carbon black*2 (parts by weight) | Metal containing dye*3 (parts by weight) |
|---|---|---|---|---|
| A | 100 | 0 | 5 | 2 |
| B | 95 | 5 | 5 | 2 |
| C | 85 | 15 | 5 | 2 |
| D | 70 | 30 | 5 | 2 |
| E | 50 | 50 | 5 | 2 |
| F | 40 | 60 | 5 | 2 |
| G | 30 | 70 | 5 | 2 |

*1Styrene-butyl acrylate copolymer crosslinked with divinylbenzene
*2REGAL 400R supplied by Cabot
*3Zapon Fast Black B supplied by BASF.

Triboelectric charge amount of each toner was measured by mixing with iron powders accoding to the blow-off method. Following the procedures of Example 1, each toner was used for development and fixed. The resulting image density, fog density and fixing temperature are as shown in Table 2, FIG. 3 and FIG. 4.

TABLE 2

| Toner No. | Triboelectric Charge amount (μc/g) | Maximum density | Fog density | Fixing temperature (°C.) |
|---|---|---|---|---|
| A | 7.4 | 1.40 | 0.70 | 130 |
| B | 6.5 | 1.31 | 0.42 | 130 |
| C | 6.0 | 1.12 | 0.13 | 135 |
| D | 5.8 | 1.06 | 0.02 | 140 |
| E | 4.9 | 0.93 | 0.02 | 155 |
| F | 3.1 | 0.61 | 0.02 | 170 |
| G | 1.8 | 0.48 | 0.02 | 190 |

In view of the above results, it is clear that the effective content of magnetic powders in the present invention is 10–50% by weight(Toner Nos. C, D and E) which gives a high image density, low fog density and moderate fixing temperature which is not so high. On the contrary, when the content is lower than the above mentioned range(Toner Nos. A and B), there is obtained unclear images of high fog density. Further, when the content is higher than the above mentioned range(Toner Nos. F and G), there is obtained a toner which gives a low maximum density and is of low fixability.

EXAMPLE 8

50 parts by weight of a styrene-butyl acrylate copolymer, 50 parts by weight of styrene-maleic acid copolymer, 30 parts by weight of magnetic powders, and 2 parts by weight of a metal containing dye(tradename, Zapon Fast Black B, supplied by BASF) were mixed by a ball-mill and then melted and kneaded by a roll-mill. After cooling, the resulting product was roughly crushed by a hammer-mill and then pulverized by a supersonic jet pulverizer. The resulting powders were classified by a wind classifier(Mikroplex 132 MP, tradename, supplied by Alpine AG.) and there was obtained a toner having a number average particle size of 12.5 microns and a distribution of particle size as shown below:

| Particle size | Weight % |
|---|---|
| not more than 5 microns | 0.31 |
| 20–35 microns | 23.6 |
| exceeding 35 microns | 2.1 |

100 parts by weight of the resulting toner was mixed with 0.3 parts by weight of colloidal silica to produce a developer. Following the procedure of Example 1, image formation was effected by using the toner. There were obtained images of a good reproducibility of thin lines. When image formation was effected at a high humidity, i.e. 30° C., 85%, the image density was substantially not lowered and good images were obtained.

EXAMPLE 9

Following a procedure similar to Example 8, there was obtained a toner having a number average particle size of 9.8 microns and the following particle size distribution:

| Particle size | Weight % |
|---|---|
| not more than 5 microns | 0.40 |
| 20–35 microns | 18.7 |
| exceeding 35 microns | 0.9 |

The resulting toner was used as in Example 8 and there was obtained a result similar to that of Example 8.

EXAMPLE 10

Following a procedure similar to Example 8, there was produced a toner having a number average particle size of 14.6 microns and the following particle size distribution:

| Particle size | Weight % |
|---|---|
| not more than | 0.19 |

-continued

| Particle size | Weight % |
|---|---|
| 5 microns | |
| 20–35 microns | 32.6 |
| exceeding 35 microns | 3.7 |

The resulting toner was used as in Example 8 and a result similar to that of Example 8 was obtained.

EXAMPLE 11

Following a procedure similar to Example 8, there was obtained a toner having a number average particle size of 18.0 microns and the following particle size distribution:

| Particle size | Weight % |
|---|---|
| not more than 5 microns | 0.11 |
| 20–35 microns | 43.5 |
| exceeding 35 microns | 8.8 |

The resulting toner was used as in Example 8 and a result similar to that of Example 8 was obtained.

EXAMPLE 12

The procedures of Example 8 were repeated except that 100 parts by weight of styrene-butyl methacrylate copolymer, 50 parts by weight of magnetic powders, and 2 parts by weight of a metal containing dye (Zapon Fast Black B, supplied by BASF) were used for preparing a toner. There was produced a toner having a number average particle size of 11.5 microns and the following particle size distribution:

| Particle size | Weight % |
|---|---|
| not more than 5 microns | 0.29 |
| 20–35 microns | 19.3 |
| exceeding 35 microns | 5.6 |

100 parts by weight of the resulting toner was mixed with 0.2 parts by weight of a colloidal silica. Image formation procedure of Example 8 was repeated except that the distance between the ear cutting blade and the sleeve was 0.2 mm and the distance between the insulating layer surface and the sleeve surface was 0.3 mm, and an AC bias of 200 Hz and 800 V was applied to the sleeve surface at the developing portion.

There was obtained an image of a high resolution and good gradation. Even at a high humidity the image density was not lowered.

EXAMPLE 13

Following a procedure of Example 8, there was obtained a toner of a number average particle size of 8.5 microns and of the following particle size distribution:

| Particle size | Weight % |
|---|---|
| not more than 5 microns | 0.82 |
| 20–35 microns | |
| exceeding 35 microns | 0.8 |

-continued

Developing was effected by using the resulting toner following the procedure of Example 12, and the result was similar to that of Example 12.

COMPARISON EXAMPLE 1

Following the procedure of Example 8, there was obtained a toner of a number average particle size of 7.0 microns and the following particle size distribution:

| Particle size | Weight % |
|---|---|
| not more than 5 microns | 0.65 |
| 20–35 microns | 3.5 |
| exceeding 35 microns | 0 |

Image formation was effected by using the resulting toner following the procedure of Example 8. The resulting images were good at a normal temperature and humidity (20° C., 50%), but were poor with a lowered image density at a high humidity (30° C., 85%).

COMPARISON EXAMPLE 2

Following the procedure of Example 8, there was obtained a toner having a number average particle size of 15.7 microns and the following particle size distribution:

| Particle size | Weight % |
|---|---|
| not more than 5 microns | 2.1 |
| 20–35 microns | 62.3 |
| exceeding 35 microns | 18.0 |

Image formation following the procedure of Example 8 gave a good result at first, but in a 500 sheets copying test (durability test) there were obtained poor images.

What we claim is:

1. A process for developing an electrostatic image which comprises the steps of:

defining a developing zone by disposing an electrostatic image bearing member having an electrostatic image on the surface thereof and a developer carrying member in opposed relationship and with a clearance therebetween;

providing a layer of magnetic developer on the surface of said developer carrying member having a thickness less than the distance defined by said clearance at the developing zone, wherein said magnetic developer is insulating so as to generate and maintain a triboelectric charge and contains 10–50 percent by weight of magnetic toner particles which are 20–35 microns in size; and electrically transferring the magnetic developer having a triboelectric charge to the electrostatic image bearing member in the presence of a magnetic field.

2. A process according to claim 1 in which the magnetic toner particles contain 10–50% by weight of magnetic powder.

3. A process according to claim 1 in which the insulating magnetic developer contains not more than 10% by weight of magnetic toner particles of a size exceeding 35 microns.

4. A process according to claim 1 in which the insulating magnetic developer contains not more than 1% of magnetic toner particles of a size of not more than 5 microns.

5. A process according to claim 1 in which the developer carrying member is a drum provided with a magnet inside the drum.

6. A process according to claim 1 in which the thickness of the layer of the insulating magnetic developer carried on the developer carrying member is 30–300 microns.

7. A process according to claim 1 in which the surface speed of the electrostatic image bearing member is substantially the same as that of the developer layer carried on the developer carrying member.

8. A process according to claim 1 in which a member controlling the thickness of the insulating magnetic developer carried on the developer carrying member is magnetizable.

9. A process according to claim 1 in which the surface magnetic flux density of the developer carrying member ranges from 200 to 1300 gauss.

10. A process according to claim 1 in which the surface magnetic flux density ranges from 600 to 1300 gauss.

11. A process according to claim 1 in which an AC bias is applied between the developer carrying member and the electrostatic image bearing member.

* * * * *

UNITED STATES PATENT OFFICE

CERTIFICATE OF CORRECTION

Patent No. 4,299,900 Dated November 10, 1981

Inventor(s) YASUO MITSUHASHI, ET AL.

It is certified that error appears in the above-identified patent and that said Letters Patent are hereby corrected as shown below:

Column 1, line 49, "paticles" should read --particles--.

Column 2, line 5, "triboelectorically" should read --triboelectrically--;
line 11, "tht" should read --that--;
line 24, "adventageous" should read --advantageous--;
line 27, "and" should read --an--;
lines 30 - 31, "magentic" should read --magnetic--;
line 35, "toner particles one another" should read --toner particles with one another--.

Column 4, line 38, "proces" should read --process--.

Column 5, line 17, "phtosensitive" should read --photosensitive--; "members, member" should read --members, members--;
line 49, "lo" should read --10--.

Column 6, line 31, "in very small" should read --is very small--;
line 35, "form" should read --from--;
line 37, "preferaby" should read --preferably--;
line 57, "of electric" should read --of the electric--.

Column 7, line 12, "particle" should read --particles--.

UNITED STATES PATENT OFFICE

CERTIFICATE OF CORRECTION

Patent No. 4,299,900 Dated November 10, 1981

Inventor(s) YASUO MITSUHASHI, ET AL.

It is certified that error appears in the above-identified patent and that said Letters Patent are hereby corrected as shown below:

Column 8, line 1, "b ≦(a,5," should read --$b \geqq \frac{a}{5}$,--;
line 10, "inages" should read --images--;
line 25, "distributed" should read --disturbed--;
line 44, "sollows" should read --follows--;
lines 50 - 53, $$\text{"}Fe = \frac{VoPt}{\varepsilon t \,.\, \iota a + \frac{\varepsilon t}{\varepsilon i}\,\iota i + \frac{\varepsilon \iota}{\varepsilon p}\,\iota p + \iota t}\text{"}$$

should read $$\text{--}Fe = \frac{VoPt}{\varepsilon t \,.\, \iota a + \frac{\varepsilon t}{\varepsilon i}\,\iota i + \frac{\varepsilon t}{\varepsilon p}\,\iota p + \iota t}\text{--}$$

Column 8, line 64, "electirc" should read --electric--.

Column 9, lines 41 - 44, $$\text{"}\ \frac{W\ w\iota(\theta) - \frac{W}{10}\ w2\ (\theta)}{W\ w\iota(\theta)}\text{"}$$

should read $$\text{--}\ \frac{W\ w1(\theta) - \frac{W}{10}\ w2\ (\theta)}{W\ w_1(\theta)}\ \text{--}$$

UNITED STATES PATENT OFFICE

CERTIFICATE OF CORRECTION

Patent No. 4,299,900 Dated November 10, 1981

Inventor(s) YASUO MITSUHASHI, ET AL.

It is certified that error appears in the above-identified patent and that said Letters Patent are hereby corrected as shown below:

Column 12, line 41, "cabalt" should read --cobalt--;
lines 65 - 66, "meltkneading" should read --melt-kneading--.

Column 13, line 7, "predermined" should read --predetermined--;
line 10, "predermined" should read --predetermined--;
line 14, "Alpin AG" should read --Alpine AG--;
line 42, "electostatic" should read --electrostatic--.

Column 15, line 47, "accoding" should read --according--.

Signed and Sealed this

Twentieth Day of April 1982

[SEAL]

Attest:

GERALD J. MOSSINGHOFF

Attesting Officer

Commissioner of Patents and Trademarks